US010927598B2

(12) United States Patent
Crider

(10) Patent No.: US 10,927,598 B2
(45) Date of Patent: Feb. 23, 2021

(54) ROLL-UP DUAL CURTAIN CLOSURE SYSTEM

(71) Applicant: HH Technologies, Inc., Bremen, AL (US)

(72) Inventor: Grant W. Crider, Tampa, FL (US)

(73) Assignee: HH Technologies, Inc., Bremen, AL (US)

( * ) Notice: Subject to any disclaimer, the term of this patent is extended or adjusted under 35 U.S.C. 154(b) by 180 days.

(21) Appl. No.: 16/087,434

(22) PCT Filed: Mar. 15, 2017

(86) PCT No.: PCT/US2017/022471

§ 371 (c)(1),
(2) Date: Sep. 21, 2018

(87) PCT Pub. No.: WO2017/172362

PCT Pub. Date: Oct. 5, 2017

(65) Prior Publication Data

US 2019/0119980 A1 Apr. 25, 2019

Related U.S. Application Data

(60) Provisional application No. 62/314,160, filed on Mar. 28, 2016.

(51) Int. Cl.
*E06B 9/42* (2006.01)
*E06B 9/70* (2006.01)
(Continued)

(52) U.S. Cl.
CPC ..... *E06B 9/64* (2013.01); *E06B 9/13* (2013.01); *E06B 9/42* (2013.01); *E06B 9/581* (2013.01);
(Continued)

(58) Field of Classification Search
CPC ..... E06B 9/42; E06B 9/64; E06B 9/56; E06B 9/24; E06B 9/13; E06B 9/66; E06B 9/58;
(Continued)

(56) References Cited

U.S. PATENT DOCUMENTS 1,541,573 A * 6/1925 Jackson ..... B61D 19/002 160/114
2,349,368 A * 5/1944 Myers ..... F23L 15/02 126/285 R
(Continued)

FOREIGN PATENT DOCUMENTS

FR 2675193 A1 10/1992
WO 9604453 A1 2/1996

*Primary Examiner* — Daniel P Cahn
(74) *Attorney, Agent, or Firm* — Bush Intellectual Property Law; Kenneth M. Bush

(57) ABSTRACT

A dual curtain closure system for covering a portal wherein each curtain has a length greater than the length of the lateral margins of the portal, a first end fixedly attached across the portal at an upper end thereof, and a second end folded back on itself to define an upwardly opening pocket. An elongated rod is supported within each pocket. A first spindle winds and unwinds the first curtain and a second spindle winds and unwinds the second curtain. A drive motor is operable to simultaneously rotate the first and second spindles such that the upwardly opening pockets of the curtains are concomitantly raised or lowered. A predetermined distance between the rods is maintained as the pockets are raised or lowered, which facilitates sealing of the curtains to the lateral margins of the portal as the curtains are lowered.

12 Claims, 4 Drawing Sheets

(51) Int. Cl.

| | |
|---|---|
| ***E06B 9/64*** | (2006.01) |
| ***E06B 9/13*** | (2006.01) |
| ***E06B 9/58*** | (2006.01) |
| ***E06B 9/66*** | (2006.01) |
| *E06B 9/24* | (2006.01) |

(52) U.S. Cl.
CPC ..... *E06B 9/582* (2013.01); *E06B 9/66* (2013.01); *E06B 9/70* (2013.01); *E06B 2009/2458* (2013.01)

(58) Field of Classification Search
CPC .. E06B 9/582; E06B 9/581; E06B 2009/2458; E06B 9/70
See application file for complete search history.

(56) References Cited

U.S. PATENT DOCUMENTS 4,151,871 A 5/1979 Ryan
4,290,473 A * 9/1981 Pierson ..... E06B 9/24 160/120
4,298,048 A * 11/1981 Roller ..... E06B 9/68 160/243
5,353,859 A 10/1994 Oltahfer et al.
5,392,549 A * 2/1995 Castro ..... G09F 11/21 160/241
5,538,065 A * 7/1996 G eraud ..... A47H 23/06 160/120
5,566,736 A * 10/1996 Crider ..... E06B 9/13 160/121.1
5,785,105 A * 7/1998 Crider ..... E06B 9/13 160/243
6,138,739 A * 10/2000 Crider ..... E06B 9/42 160/273.1
6,942,001 B1 * 9/2005 Crider ..... E06B 9/42 160/241
7,059,377 B2 * 6/2006 Nien ..... E06B 9/42 160/120
8,439,099 B1 * 5/2013 Crider ..... E06B 9/13 160/121.1
9,556,672 B2 * 1/2017 Pfaff ..... E06B 9/13
2007/0277938 A1 * 12/2007 Crider ..... E06B 7/232 160/121.1
2011/0061821 A1 * 3/2011 Kim ..... E06B 9/264 160/305
2014/0360679 A1 * 12/2014 Crider ..... E06B 9/64 160/121.1
2018/0106046 A1 * 4/2018 Castel ..... E04F 10/0607

* cited by examiner

ROLL-UP DUAL CURTAIN CLOSURE SYSTEM

TECHNICAL FIELD

The present invention relates to closures for windows, doors, or other portals. More particularly, the present invention relates to a dual curtain closure system utilizing roll-up curtains that are reversibly attachable to the lateral margins of a portal.

BACKGROUND ART

Roll-up curtain systems are known in the prior art. One such roll-up curtain system taught in U.S. Pat. No. 5,566,736 to Crider et al., incorporated herein by reference, and specifically shown in FIG. 5 of the '736 patent, has two curtains, two channel members, and two elongated rods. The channel members are C-shaped and the lateral ends of each elongated rod are slidably secured therein. Each rod is supported in an upturned pocket of a single curtain and each curtain is designed to form a seal with only the adjacent lateral side of each channel member. Affixed to the longitudinal sides of each curtain and the lateral sides of the channel members are complementary closure members, such as hook and loop fastening material. A related roll-up dual curtain closure system is taught in U.S. Pat. No. 8,439,099 to Crider, also incorporated herein by reference.

In prior art roll-up dual curtain closure systems, the second ends of the curtains are wound about a common spindle. As the curtains are wound about the spindle in an overlapping manner, more of the length of the outermost curtain is wound per revolution than the length of the innermost curtain. As a result, the upturned pockets and the elongated rods supported therein separate from each other as the curtains are raised. It has been discovered that, as the rods separate from each other, the seal between the curtains and the channel members is not as secure.

What is needed, therefore, is a roll-up dual curtain closure system that overcomes the foregoing problem encountered with prior art roll-up dual curtain closure systems.

DISCLOSURE OF THE INVENTION

The present invention is a roll-up dual curtain closure system for covering a portal. The closure system preferably comprises a pair of spaced apart opposing channel members defining lateral margins of the portal, wherein a first channel member has opposing attachment members and a second channel member has opposing attachment members. The closure system further comprises first and second curtains, wherein each curtain has a length greater than the length of the lateral margins of the portal, a first end fixedly attached across the portal at an upper end thereof, and a second end folded back on itself to define an upwardly opening pocket. A first elongated rod is supported within the pocket of the first curtain and a second elongated rod is supported within the pocket of the second curtain, wherein both rods having opposing ends captured within the opposing channel members. A releasable fastening material, such as hook and loop fastening material, is affixed to the attachment members and to the elongated sides of the curtains.

A first spindle is mounted superjacent the portal for winding and unwinding the first curtain such that the height of the upwardly opening pocket of the first curtain is adjustable. A second spindle is mounted superjacent the portal for winding and unwinding the second curtain such that the height of the upwardly opening pocket of the second curtain is adjustable. A drive roller is mounted superjacent the portal and is cooperatively connected to the first and second spindles. The drive roller is operable to simultaneously rotate the first and second spindles such that the heights of the upwardly opening pockets of the first and second curtains are concomitantly adjusted. A predetermined distance between the first and second rods is fixed as the heights of the upwardly opening pockets of the first and second curtains are concomitantly adjusted.

In operation, the spindles are rotated so that the curtains are unrolled therefrom. The pockets and the elongated rods are lowered to allow the curtains to cover the portal opening. As the curtains are lowered, the lowering elongated rods roll along the inside surfaces of the curtains and urge the curtains against the attachment members. The mating fastening material engages, thus forming a secure attachment between the curtains and the channel members. As the spindles are rotated so that the curtains are wound thereupon, the pockets and elongated rods are raised and the portal is uncovered. As the curtains are raised, the mating fastening material disengages, thus detaching the curtains from the channel members. Whether the curtain pockets and elongated rods are raised or lowered, the predetermined distance between the first and second rods is maintained.

In an alternate embodiment, the closure system further comprises a flexible panel and a third spindle mounted superjacent the portal for winding and unwinding the panel. A first end of the panel is attached to the third spindle and a second end of the panel is preferably attached to a rigid bar such that rotation of the third spindle urges the second end of the panel along a vertical path between the first and second curtains such that the height of the rigid bar is adjustable. The rigid bar is operable to buttress the curtains against environmental impact. A plurality of rigid bars can be attached along the length of the panel if desired.

These and other features of the invention will become apparent from the following detailed description of the invention.

DETAILED DESCRIPTION OF THE INVENTION

This application claims the priority and benefit of U.S. Provisional Patent Application No. 62/314,160 filed Mar. 28, 2016, which is hereby incorporated by reference in its entirety herein.

Figure 1:
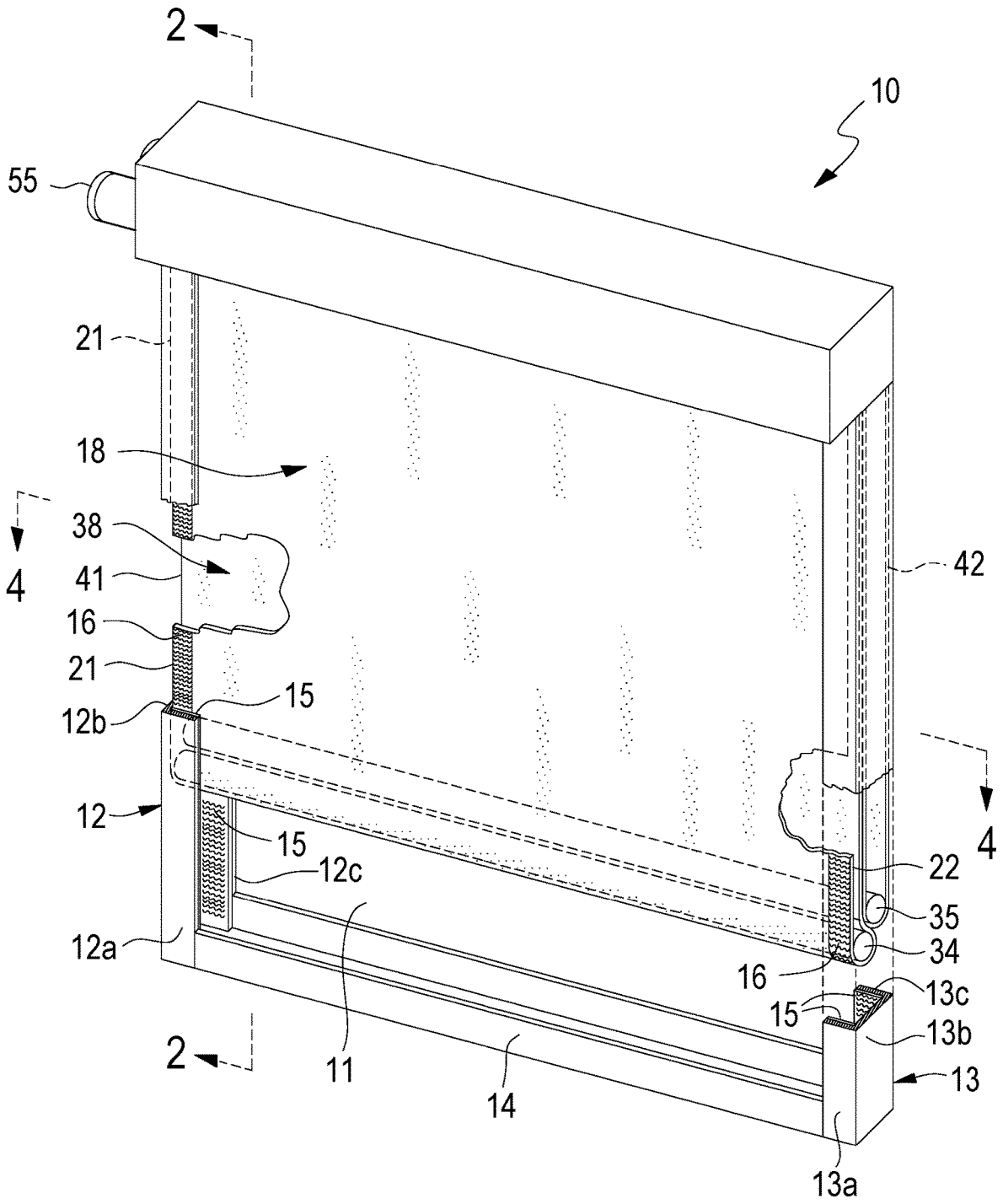
FIG. 1 is a front perspective view of the present invention shown partially in section.

The preferred apparatus of the dual curtain closure system is indicated generally by the numeral 10. As best shown in FIG. 1, the apparatus 10 has first 12*a*, second 12*c*, third 13*a*, and fourth 13*c* attachment members. The attachment members 12*a*, 12*c*, 13*a*, 13*c* each extend the full vertical length of the portal or opening 11 to be covered and each terminate at a lower end 14, which may be, for example, a floor or an upwardly opening channel member which extends across the width of the opening 11. The attachment members 12*a*, 12*c*, 13*a*, 13*c* are positioned in pairs such that the first 12*a* and second 12*c* attachment members define one lateral margin of the opening 11 and the third 13*a* and fourth 13*c* attachment members define the opposing lateral margin of the opening 11. The distance between the first 12*a* and second 12*c* attachment members is preferably equal to the distance between the third 13*a* and fourth 13*c* attachment members.

Figure 4:
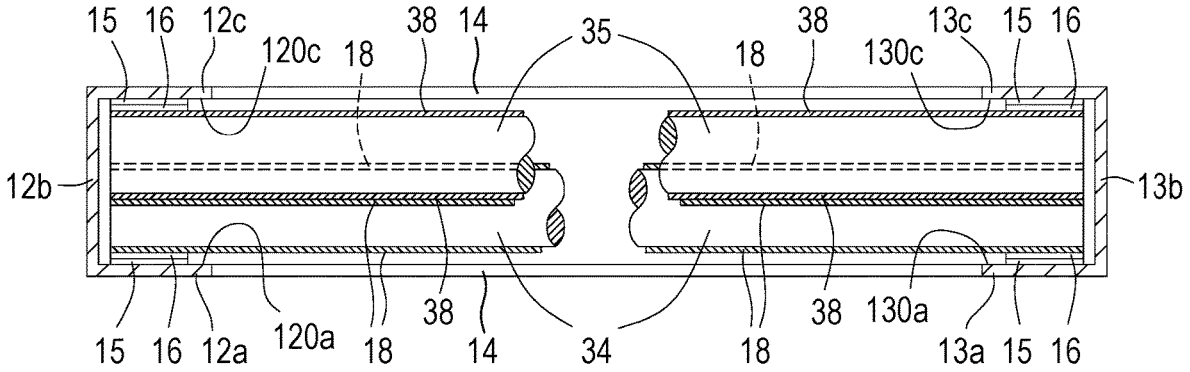
FIG. 4 is a top sectional view of the invention taken along line 4-4 of FIG. 1.

As best shown in FIG. 4, each attachment member 12*a*, 12*c*, 13*a*, 13*c* has an inner surface 120*a*, 120*c*, 130*a*, 130*c* and the inner surfaces of each pair of attachment members preferably face one another. Preferably, each pair of attachment members is part of a channel member, such that the apparatus 10 has first 12 and second 13 channel members. The first channel member 12 preferably has first 12*a* and second 12*c* attachment members as well as a perpendicular member 12*b* attached therebetween and the second channel member 13 likewise preferably has third 13*a* and fourth 13*c* attachment members as well as a perpendicular member 13*b* attached therebetween. Each perpendicular member 12*b*, 13*b* is preferably substantially orthogonal to both attachment members attached thereto such that each channel member 12, 13 is cross-sectionally substantially C-shaped. Each channel member 12, 13 is preferably directed inwardly such that the channels formed by the C-shaped channel members 12, 13 face one another. The channel members 12, 13 and lower end 14 are preferably made of a durable material capable of resisting wear, such as metal.

Figure 2:
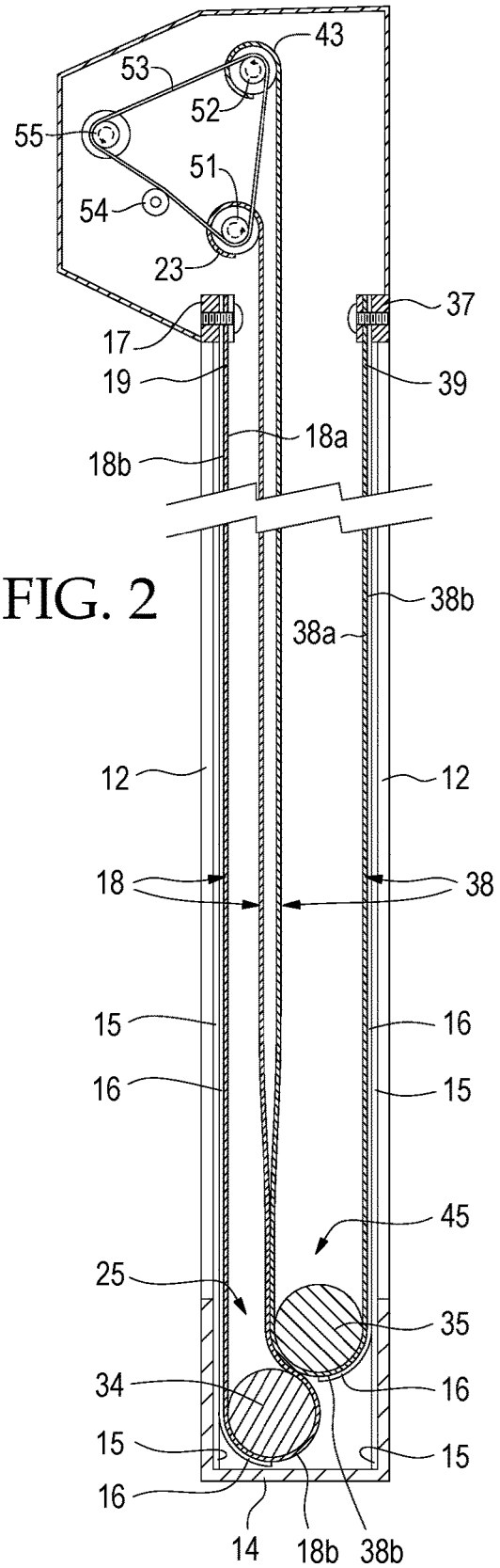
FIG. 2 is a side sectional view of the invention taken along line 2-2 of FIG. 1 with the curtains shown in a lowered position.
Figure 3:
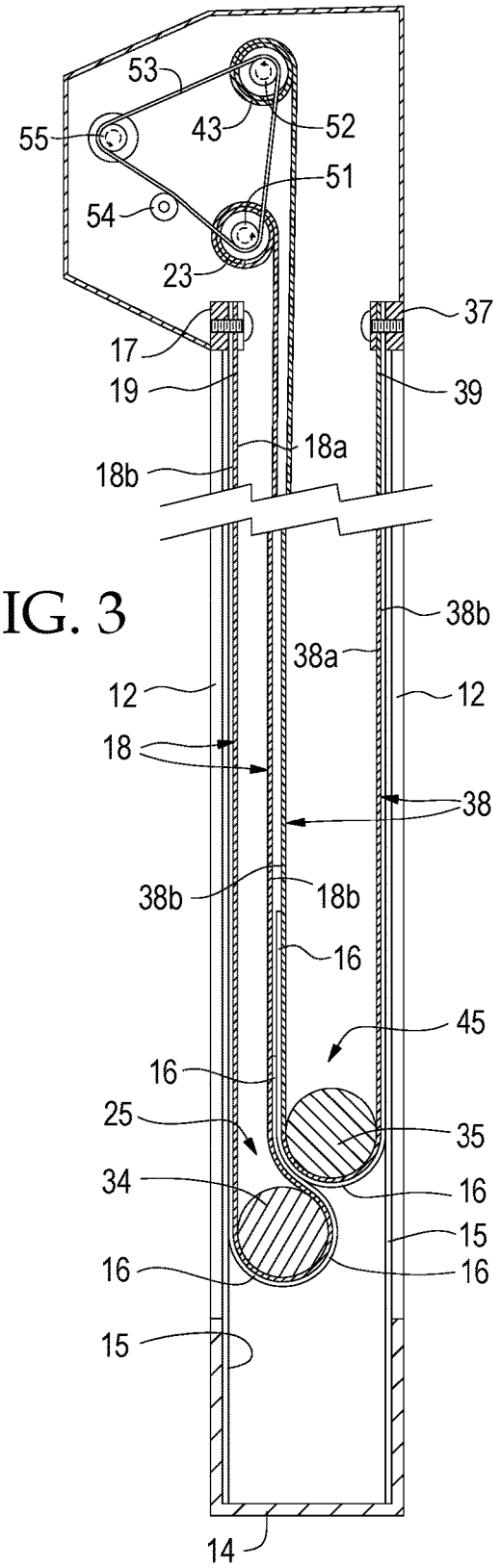
FIG. 3 is a side sectional view of the invention of FIG. 2 with the curtains shown in a partially raised position.

As best shown in FIGS. 2-3, the apparatus 10 has a first brace 17 and second brace 37. Each brace 17, 37 preferably extends across the width of the opening 11 and is mounted superjacent the opening 11. Each brace 17, 37 has opposing ends, each of which is preferably attached to a channel member 12, 13. The braces 17, 37 are preferably made of metal for increased durability. Attached to the first brace 17 is a first end 19 of a first curtain 18 and attached to the second brace 37 is a first end 39 of a second curtain 38. Each curtain 18, 38 is preferably a flexible material selected in accordance with the purposes of the present invention for the ability of the curtain 18, 38 to block or transmit light, air, or moisture from one side of the curtain 18, 38 to the other. The length of each curtain 18, 38 is preferably greater than the length of the lateral margins of the opening 11 such that each curtain 18, 38 is capable of covering the entire opening 11. The first curtain 18 has first 21 and second 22 longitudinal sides and the second curtain 38 has first 41 and second 42 longitudinal sides with the first longitudinal side 21, 41 of each curtain 18, 38 positioned along the same lateral margin as the first channel member 12 and with the second longitudinal side 22, 42 of each curtain 18, 38 positioned along the same lateral margin as the second channel member 13. Each curtain 18, 38 has an interior surface 18*a*, 38*a* and an exterior surface 18*b*, 38*b*.

Each longitudinal side 21, 22, 41, 42 of each exterior surface 18*b*, 38*b* of each curtain 18, 38 is releasably attachable to one attachment member 12*a*, 12*c*, 13*a*, 13*c*. Specifically, the first longitudinal side 21 of the exterior surface 18*b* of the first curtain 18 is releasably attachable to the first attachment member 12*a*, the second longitudinal side 22 of the exterior surface 18*b* of the first curtain 18 is releasably attachable to the third attachment member 13*a*, the first longitudinal side 41 of the exterior surface 38*b* of the second curtain 38 is releasably attachable to the second attachment member 12*c*, and the second longitudinal side 42 of the exterior surface 38*b* of the second curtain 38 is releasably attachable to the fourth attachment member 13*c*. The releasable attachments of the longitudinal sides 21, 22, 41, 42 to the attachment members 12*a*, 12*c*, 13*a*, 13*c* are preferably achieved through hook and loop fastening material, although other fastening means may be used. For example, U.S. Pat. No. 7,828,037 to Crider, incorporated herein by reference, teaches a roll-up curtain system having magnetic fastening means. Each attachment member 12*a*, 12*c*, 13*a*, 13*c* preferably has hook fastening material 15 affixed to the inner surface 120*a*, 120*c*, 130*a*, 130*c* thereof. Affixed to each longitudinal side 21, 22, 41, 42 preferably is loop fastening material 16 complementary to the hook fastening material 15 affixed to the attachment members 12*a*, 12*c*, 13*a*, 13*c*. The attachment of loop fastening material 16 to each longitudinal side 21, 22, 41, 42 is preferably along, or in the alternative relatively near, the lateral edges of the curtains 18, 38.

The first curtain 18 has a second end 23 opposite the first end 19 and the second curtain 38 has a second end 43 opposite the first end 39. As best shown in FIGS. 2-3, each second end 23, 43 is upturned such that each curtain 18, 38 has an upwardly opening pocket 25, 45 formed therein. Supported within the pocket 25 of the first curtain 18 is a first elongated rod 34 and supported within the pocket 45 of the second curtain 38 is a second elongated rod 35. The heights of the pockets 25, 45 are adjustable. The heights of the pockets 25, 45 determines the area of the opening 11 covered by the curtains 18, 38. The second end 23 of the first curtain 18 is connected to a first transverse take-up roller or spindle 51 mounted superjacent the opening 11. The spindle 51 is preferably driven by a reversible drive motor 55 operably connected to a selected means of control. As the spindle 51 rotates, the second end 23 of the first curtain 18 either wraps (winds) around or unwraps (unwinds) from the spindle 51, altering the height of the first pocket 25. The second end 43 of the second curtain 38 is connected to a second transverse take-up roller or spindle 52 mounted superjacent the opening 11. The second spindle 52 is preferably also driven by the reversible drive motor 55. As the spindle 52 rotates, the second end 43 of the second curtain 38 either wraps (winds) around or unwraps (unwinds) from the spindle 52, altering the height of the second pocket 45. The spindles 51, 52 are operably connected to the motor 55 via a drive belt 53. An adjustable tensioner 54 preferably engages the drive belt 53 to maintain a predetermined suitable tension on the drive belt 53. The spindles 51, 52 are preferably made of metal or durable plastic.

As noted above, supported within the pocket 25 of the first curtain 18 is a first elongated rod 34 and supported within the pocket 45 of the second curtain 38 is a second elongated rod 35. Each elongated rod 34, 35 extends across the width of the opening 11 and is preferably at least as long as the second end of each curtain 18, 38. The rods 34, 35 are preferably of equal size, shape, and material, preferably each made of solid or tubular pipe made of a durable material such as metal or fiberglass, which may be covered with flexible foam for safety. For example, U.S. Pat. No. 8,919,415 to Crider, incorporated herein by reference, teaches an impact resistant tension rod suitable for use in the present invention. Preferably, the opposing ends of each elongated rod 34, 35 are captured within the channel members 12, 13 such that the rods 34, 35 are capable of rolling vertically within the channel members 12, 13 but are not capable of substantial movement in the horizontal plane. As best shown in FIGS. 2-3, the distance between the attachment members 12*a*, 12*c*, 13*a*, 13*c* of each channel member 12, 13 is preferably less than twice the diameter of each elongated rod 34, 35 such that the elongated rods 34, 35 may be positioned such that the second rod 35 is maintained at a height greater than the height of the first elongated rod 34.

As the spindles 51, 52 rotate so that the curtains 18, 38 are unrolled therefrom, the pockets 25, 45 and the elongated rods 34, 35 are lowered to allow the curtains 18, 38 to cover the opening 11. As the curtains 18, 38 are lowered to cover a larger area of the opening 11, the lowering elongated rods 34, 35 roll along the inside surfaces 18*a*, 38*a* of the curtains 18, 38 and urge the curtains 18, 38 against the attachment members 12*a*, 12*c*, 13*a*, 13*c*. This force applied against the longitudinal sides 21, 22, 41, 42 of the exterior surfaces 18*b*, 38*b* pushes the loop fastening material 16 affixed thereto into the hook fastening material 15 affixed to the attachment members 12*a*, 12*c*, 13*a*, 13*c*, thus causing a secure attachment between the curtains 18, 38 and the channel members 12, 13. As the spindles 51, 52 rotate so that the curtains 18, 38 are wound thereupon, the pockets 25, 45 and the elongated rods 34, 35 are raised, the curtains 18, 38 are raised, and the opening 11 is uncovered. As the curtains 18, 38 are raised, the loop fastening material 16 is pulled from the hook fastening material 15, thus detaching the curtains 18, 38 from the channel members 12, 13.

It has been discovered that the curtains 18, 38 seal against the channel members 12, 13 better along the vertical length of the opening 11 when the rods 34, 35 are immediately adjacent each other with only the curtains 18, 38 therebetween. In other words, when the curtains 18, 38 are lowering and the rods 34, 35 are in substantial abutment with each other, the rods 34, 35 are pushed outward away from each other so that the loop fastening material 16 is pushed into the hook fastening material 15 to create a more secure attachment between the curtains 18, 38 and the channel members 12, 13 than when the rods 34, 35 are not in substantial abutment. In prior art roll-up dual curtain assemblies (e.g. U.S. Pat. Nos. 5,566,736 and 8,439,099), the second ends of the curtains are wound about a common spindle. As the curtains are wound about the spindle in an overlapping manner, more of the length of the outermost curtain is wound per revolution than the length of the innermost curtain. As a result, the rods (and pockets) separate from each other, which increases as the curtains are raised (see e.g. FIGS. 2-3 of U.S. Pat. No. 8,439,099). As the rods move away from each other, they no longer push away from each other and the seal between the curtains and the channel members is not as secure. By having the second end of each curtain 18, 38 wound upon its own dedicated spindle, the rods 34, 35 of the present invention are maintained in a constant distance relationship with each other, which allows the seal between the curtains 18, 38 and the channel members 12, 13 to be optimized (see FIGS. 2-3 of the present invention).

Figure 5:
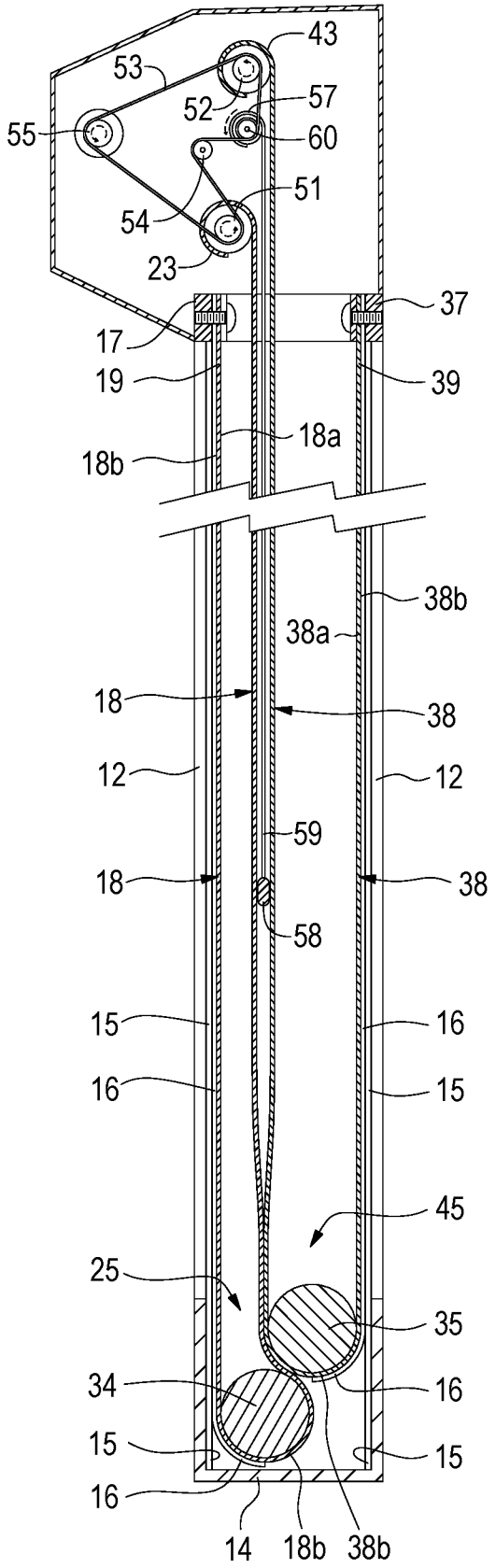
FIG. 5 is a side sectional view of an alternate embodiment of the invention.

In an alternate embodiment shown in FIG. 5, a flexible panel 56 is secured at its first end 57 to a third transverse take-up roller or spindle 60 mounted superjacent the opening 11 preferably between the first spindle 51 and the second spindle 52. The panel 56 has a rigid horizontal bar 58 preferably secured to a second end 59 of the panel 56. Additional horizontal bars 58 can be located along the height of the panel 56. The third spindle 60 is preferably also driven by the reversible drive motor 55. As the spindle 60 rotates, the first end 57 of the panel 56 either wraps (winds) around or unwraps (unwinds) from the spindle 60, altering the height of the bar 58. When lowered, the bar 58 will be positioned horizontally at a predetermined height across the opening 11 between the curtains 18, 38 to act as a structural member to buttress the curtains 18, 38 against environmental impacts, such as from wind, that could misalign the curtains 18, 38.

The foregoing discussion along with the Figures discloses and describes various exemplary implementations. These implementations are not meant to limit the scope of coverage, but, instead, to assist in understanding the context of the language used in this specification and in the claims. Upon study of this disclosure and the exemplary implementations herein, one of ordinary skill in the art may readily recognize that various changes, modifications and variations can be made thereto without departing from the spirit and scope of the inventions as described herein and as defined in the following claims.

The invention claimed is:

1. A dual curtain closure system for covering a portal, comprising:

a) a pair of spaced apart opposing channel members defining lateral margins of the portal, wherein said channel members comprise a first channel member having a first attachment member and an opposing second attachment member, wherein said channel members further comprise a second channel member having a third attachment member and an opposing fourth attachment member;

b) a first curtain having a length greater than a length of said lateral margins of the portal, elongated side portions, and a first curtain first end and a first curtain second end each having a width commensurate with a separation of said channel members, with said first curtain first end being fixedly attached across the portal at an upper end thereof, said first curtain second end folded back on itself to define an upwardly opening first curtain pocket;

c) a second curtain having a length greater than the length of said lateral margins of the portal, elongated side portions, and a second curtain first end and a second curtain second end each having a width commensurate with the separation of said channel members, with said second curtain first end being fixedly attached across the portal at an upper end thereof, said second curtain second end folded back on itself to define an upwardly opening second curtain pocket;

d) a first elongated rod supported within said first curtain pocket, and having opposing ends captured within said opposing channel members;

e) a second elongated rod supported within said second curtain pocket, and having opposing ends captured within said opposing channel members, wherein said second rod is maintained at a height greater than said first rod;

f) first fastening material affixed to each of said first attachment member, said second attachment member, said third attachment member, and said fourth attachment member;

g) second fastening material affixed to each of said elongated side portions of said first curtain and said second curtain;

h) a first spindle mounted superjacent the portal for winding and unwinding said first curtain, wherein said first curtain second end is attached to said first spindle such that rotation of said first spindle is operable to urge said first curtain second end along a vertical path such that a height of said upwardly opening first curtain pocket is adjustable;

i) a second spindle mounted superjacent the portal for winding and unwinding said second curtain, wherein said second curtain second end is attached to said second spindle such that rotation of said second spindle is operable to urge said second curtain second end along a vertical path such that a height of said upwardly opening second curtain pocket is adjustable; and j) a drive motor cooperatively connected to said first spindle and said second spindle, wherein said drive motor is operable to simultaneously rotate said first spindle and said second spindle such that said height of said upwardly opening first curtain pocket and said height of said upwardly opening second curtain pocket are concomitantly adjusted;

k) wherein said first rod and said second rod are maintained in substantial abutment with each other through said first curtain and said second curtain as said height of said upwardly opening first curtain pocket and said height of said upwardly opening second curtain pocket are concomitantly adjusted;

l) wherein said first rod and said second rod are operable to push away from each other as said upwardly opening first curtain pocket and said upwardly opening second curtain pocket are concomitantly lowered;

m) wherein said first rod and said second rod are operable to push said second fastening material of said elongated side portions of said first curtain and said second curtain into said first fastening material of said first attachment member, said second attachment member, said third attachment member, and said fourth attachment member to promote a secure attachment between said first curtain and said channel members and said second curtain and said channel members as said upwardly opening first curtain pocket and said upwardly opening second curtain pocket are concomitantly lowered.

2. The dual curtain closure system according to claim 1, wherein said drive motor, said first spindle, and said second spindle are operably connected to each other by a drive belt.

3. The dual curtain closure system according to claim 2, further comprising an adjustable tensioner operably engaging said drive belt to maintain a tension on said drive belt.

4. The dual curtain closure system according to claim 1, wherein said second fastening material affixed to said elongated side portions of said first curtain is complementary to and capable of being releasably attached to said first fastening material affixed to said first attachment member and said third attachment member, and wherein said second fastening material affixed to said elongated side portions of said second curtain is complementary to and capable of being releasably attached to said first fastening material affixed to said second attachment member and said fourth attachment member.

5. The dual curtain closure system according to claim 4, wherein said first fastening material is hook fastening material and said second fastening material is loop fastening material.

6. A dual curtain closure system for covering a portal, comprising:

a) a pair of spaced apart opposing channel members defining lateral margins of the portal, wherein said channel members comprise a first channel member having a first attachment member and an opposing second attachment member, wherein said channel members further comprise a second channel member having a third attachment member and an opposing fourth attachment member;

b) a first curtain having a length greater than a length of said lateral margins of the portal, elongated side portions, and a first curtain first end and a first curtain second end each having a width commensurate with a separation of said channel members, with said first curtain first end being fixedly attached across the portal at an upper end thereof, said first curtain second end folded back on itself to define an upwardly opening first curtain pocket;

c) a second curtain having a length greater than the length of said lateral margins of the portal, elongated side portions, and a second curtain first end and a second curtain second end each having a width commensurate with the separation of said channel members, with said second curtain first end being fixedly attached across the portal at an upper end thereof, said second curtain second end folded back on itself to define an upwardly opening second curtain pocket;

d) a first elongated rod supported within said first curtain pocket, and having opposing ends captured within said opposing channel members;

e) a second elongated rod supported within said second curtain pocket, and having opposing ends captured within said opposing channel members, wherein said second rod is maintained at a height greater than said first rod;

f) first fastening material affixed to each of said first attachment member, said second attachment member, said third attachment member, and said fourth attachment member;

g) second fastening material affixed to each of said elongated side portions of said first curtain and said second curtain;

h) a first spindle mounted superjacent the portal for winding and unwinding said first curtain, wherein said first curtain second end is attached to said first spindle such that rotation of said first spindle is operable to urge said first curtain second end along a vertical path such that a height of said upwardly opening first curtain pocket is adjustable;

i) a second spindle mounted superjacent the portal for winding and unwinding said second curtain, wherein said second curtain second end is attached to said second spindle such that rotation of said second spindle is operable to urge said second curtain second end along a vertical path such that a height of said upwardly opening second curtain pocket is adjustable;

j) a drive motor cooperatively connected to said first spindle and said second spindle, wherein said drive motor is operable to simultaneously rotate said first spindle and said second spindle such that said height of said upwardly opening first curtain pocket and said height of said upwardly opening second curtain pocket are concomitantly adjusted; and k) a flexible panel and a third spindle mounted superjacent the portal for winding and unwinding said panel, wherein a panel first end is attached to said third spindle and a panel second end is attached to a rigid bar such that rotation of said third spindle is operable to urge said panel second end along a vertical path between said first curtain and said second curtain such that a height of said rigid bar is adjustable, wherein said rigid bar is operable to buttress said first curtain and said second curtain against environmental impact;

l) wherein said first rod and said second rod are maintained in substantial abutment with each other through said first curtain and said second curtain as said height of said upwardly opening first curtain pocket and said height of said upwardly opening second curtain pocket are concomitantly adjusted;

m) wherein said first rod and said second rod are operable to push away from each other as said upwardly opening first curtain pocket and said upwardly opening second curtain pocket are concomitantly lowered;

n) wherein said first rod and said second rod are operable to push said second fastening material of said elongated side portions of said first curtain and said second curtain into said first fastening material of said first attachment member, said second attachment member, said third attachment member, and said fourth attachment member to promote a secure attachment between said first curtain and said channel members and said second curtain and said channel members as said upwardly opening first curtain pocket and said upwardly opening second curtain pocket are concomitantly lowered.

7. The dual curtain closure system according to claim 6, wherein said drive motor, said first spindle, and said second spindle are operably connected to each other by a drive belt.

8. The dual curtain closure system according to claim 7, further comprising an adjustable tensioner operably engaging said drive belt to maintain a tension on said drive belt.

9. The dual curtain closure system according to claim 6, wherein said second fastening material affixed to said elongated side portions of said first curtain is complementary to and capable of being releasably attached to said first fastening material affixed to said first attachment member and said third attachment member, and wherein said second fastening material affixed to said elongated side portions of said second curtain is complementary to and capable of being releasably attached to said first fastening material affixed to said second attachment member and said fourth attachment member.

10. The dual curtain closure system according to claim 9, wherein said first fastening material is hook fastening material and said second fastening material is loop fastening material.

11. The dual curtain closure system according to claim 6, wherein said drive motor, said first spindle, said second spindle, and said third spindle are operably connected to each other by a drive belt.

12. The dual curtain closure system according to claim 11, further comprising an adjustable tensioner operably engaging said drive belt to maintain a tension on said drive belt.

* * * * *